US010869796B1

(12) United States Patent
Mathews

(10) Patent No.: US 10,869,796 B1
(45) Date of Patent: Dec. 22, 2020

(54) ROTATING LEG LIFT MACHINE

(71) Applicant: Deborrah McBride Mathews, Montevallo, AL (US)

(72) Inventor: Deborrah McBride Mathews, Montevallo, AL (US)

( * ) Notice: Subject to any disclaimer, the term of this patent is extended or adjusted under 35 U.S.C. 154(b) by 0 days.

(21) Appl. No.: 16/926,737

(22) Filed: Jul. 12, 2020

Related U.S. Application Data

(60) Provisional application No. 62/873,090, filed on Jul. 11, 2019.

(51) Int. Cl.
*A61G 7/10* (2006.01)
*A61G 7/00* (2006.01)

(52) U.S. Cl.
CPC ..... *A61G 7/1017* (2013.01); *A61G 7/1046* (2013.01); *A61G 7/1051* (2013.01); *A61G 7/1096* (2013.01)

(58) Field of Classification Search
CPC ..... A61G 7/10; A61G 7/1013; A61G 7/1015; A61G 7/1017; A61G 7/1019; A61G 7/1042; A61G 7/1046; A61G 7/1049; A61G 7/1051; A61G 7/1055; A61G 7/1057; A61G 7/1061; A61G 7/1096
USPC ..... 5/83.1, 81.1 R, 86.1, 87.1, 89.1
See application file for complete search history.

(56) References Cited

U.S. PATENT DOCUMENTS 935,170 A 9/1909 Smith
1,876,832 A * 9/1932 Bancroft ..... A61G 7/1055 5/89.1
3,203,009 A 8/1965 Lundberg
3,234,568 A * 2/1966 Fischer ..... A61G 7/1061 5/89.1
3,877,421 A 4/1975 Brown
4,221,011 A * 9/1980 Flinchbaugh ..... A61G 7/10 5/89.1
4,680,819 A * 7/1987 James ..... A61G 7/1046 5/83.1
4,703,523 A * 11/1987 James ..... A61G 7/1017 5/83.1
4,739,526 A * 4/1988 Hollick ..... A61G 7/1015 5/83.1
4,882,798 A * 11/1989 Worsnop ..... A61G 7/10 5/89.1
5,325,550 A * 7/1994 Dearstyne ..... A61G 7/10 294/67.31
5,560,054 A * 10/1996 Simon ..... A61G 7/1046 5/86.1
5,802,633 A 9/1998 Capaldi
5,815,859 A 10/1998 Lavin
5,946,748 A * 9/1999 Wang ..... A61G 7/1015 212/281
6,321,398 B1 * 11/2001 Wang ..... A61G 7/001 212/901
7,328,467 B2 2/2008 Aarestad
(Continued)

*Primary Examiner* — Robert G Santos
(74) *Attorney, Agent, or Firm* — Christopher R. Ganter, LLC

(57) ABSTRACT

A rotational leg lift machine for sanitizing a patient comprising a base assembly attached to a rigid frame work that has a vertical lifting and lowering mechanism, a rotationally driven arm that is extendable and a leg support bar that allows for a patients lower legs to be inserted into slings and gently lifting and rotation a patients legs upwards and rearwards to their torso to allow for easy and safe cleaning of patient's private areas.

18 Claims, 8 Drawing Sheets

(56) References Cited

U.S. PATENT DOCUMENTS

| | | | |
|---|---|---|---|
| 7,428,759 | B2 | 9/2008 | Bain et al. |
| 7,657,951 | B2 | 2/2010 | Tally |
| 8,272,084 | B2 | 9/2012 | Spidare et al. |
| 8,474,794 | B2 | 7/2013 | Liljedahl |
| 8,555,432 | B2 | 10/2013 | Lavin |
| 8,584,275 | B2 | 11/2013 | Nelson et al. |
| 8,656,529 | B2 | 2/2014 | Corriveau et al. |
| 8,914,920 | B2 | 12/2014 | Niklasson |
| 8,935,814 | B1 | 1/2015 | Tu |
| 9,161,871 | B2 | 10/2015 | Clement et al. |
| 9,333,138 | B2 | 5/2016 | Moriarty et al. |
| 9,527,699 | B2 | 12/2016 | Liljedahl |
| 2007/0006381 | A1 | 1/2007 | Tally |
| 2008/0216232 | A1 | 9/2008 | White et al. |
| 2010/0229299 | A1 | 9/2010 | Lear |
| 2011/0225728 | A1 | 9/2011 | Thornhill et al. |
| 2012/0240333 | A1 | 9/2012 | Niklasson |
| 2015/0052680 | A1 | 2/2015 | Brandorff et al. |
| 2017/0000672 | A1 | 1/2017 | Andersson et al. |

* cited by examiner

ROTATING LEG LIFT MACHINE

CROSS-REFERENCED TO RELATED APPLICATIONS

This application claims priority in its entirety to Provisional Application No. 62/873,090 filed on Jul. 11, 2019.

FEDERALLY SPONSORED RESEARCH

None

SEQUENCE LISTING

None

FIELD OF THE INVENTION

The invention relates to a patient rotational leg lift machine for use in proving medical care and assisting caregivers with patients who are bedridden and/or no longer have the ability to move their extremities. More specifically, the invention is a machine that enables a caregiver to ergonomically lift and position a patient's legs in such a position as it allows the caregiver to clean the patient in locations of the patient's body that are otherwise difficult to lift and maintain in position without a leg lift machine while performing cleaning of the patient as a result of natural bodily functions emitted by the patient.

BACKGROUND OF THE INVENTION

There are many circumstances in which a person may become incapacitated and unable to take care of themselves and expel natural human generated waste products in a normal and sanitary manner. When this occurs, a person must be cared for and cleaned frequently after they expel waste products. This often occurs to the elderly who are very fragile and frail. Cleaning the areas around the buttocks, crotch and thighs can be very difficult for a caregiver. Normally, this is done by shifting, lifting or rolling the patient such that the caregiver can obtain access to the aforementioned areas that need to cleaned. This can be cumbersome and difficult for caregivers that lack the physical strength and could in some cases cause the caregiver injury. Caring for a patient's healthcare needs is vital to their health and patient's that are not provided adequate care can develop bed sores and infections due to waste products that are not cleaned off a patient's body. Additionally, the actions of shifting, lifting and rolling a patient can cause injury to the tender skin of a patient and also threatens injury to joints and/or the spine in cases where a particular patient may have suffered injury or due to debilitative decline because of age. What is needed in the art is a device that overcomes these problems. Specifically, a mechanical lift that provides the natural lifting rotation of a person's thighs towards their abdomen is needed in the art. A lift that rotationally lifts a person's legs in an arc as opposed to just a vertical lift is needed in the art. As disclosed below, there is provided a solution to the aforementioned problems.

SUMMARY OF THE INVENTION

The invention is a rotational leg lift machine having a base assembly attached to a lower housing. The interior of the housing further comprises a motor gearbox housing that has mounted thereon a motor drive gearbox and shaft. Located in the interior of the lower housing is either a linear actuator, a hydraulic lift or a pneumatic lift that raises the motor gearbox housing and shaft up or down. Located at the top of the leg lift machine is an upper housing with a top cover. Attached to the shaft is a rotating arm which rotates in a vertical arc. Located on the terminal end of the rotating arm is a leg support bar that is perpendicular to the rotating arm and when deployed it is parallel with the ground. In use, the rotational leg lift machine is rolled over to a patient's bedside and in the direct vicinity of a patient's hip. The lift is then raised such that the shaft of the machine is directly in line with the top of a user's hip. The rotating arm is then rotated towards a patient's feet until it is in a parallel position with a patient's legs. A caregiver then attaches slings that are attached to the leg support and installs them underneath each patient's leg. The rotating arm is then activated and rotated rearwards towards a patient's torso and upwards such that the patient's legs are lifted to provide a caregiver access to sanitize and reclothe the undergarments of the patient.

DETAILED DESCRIPTION

Figure 1:
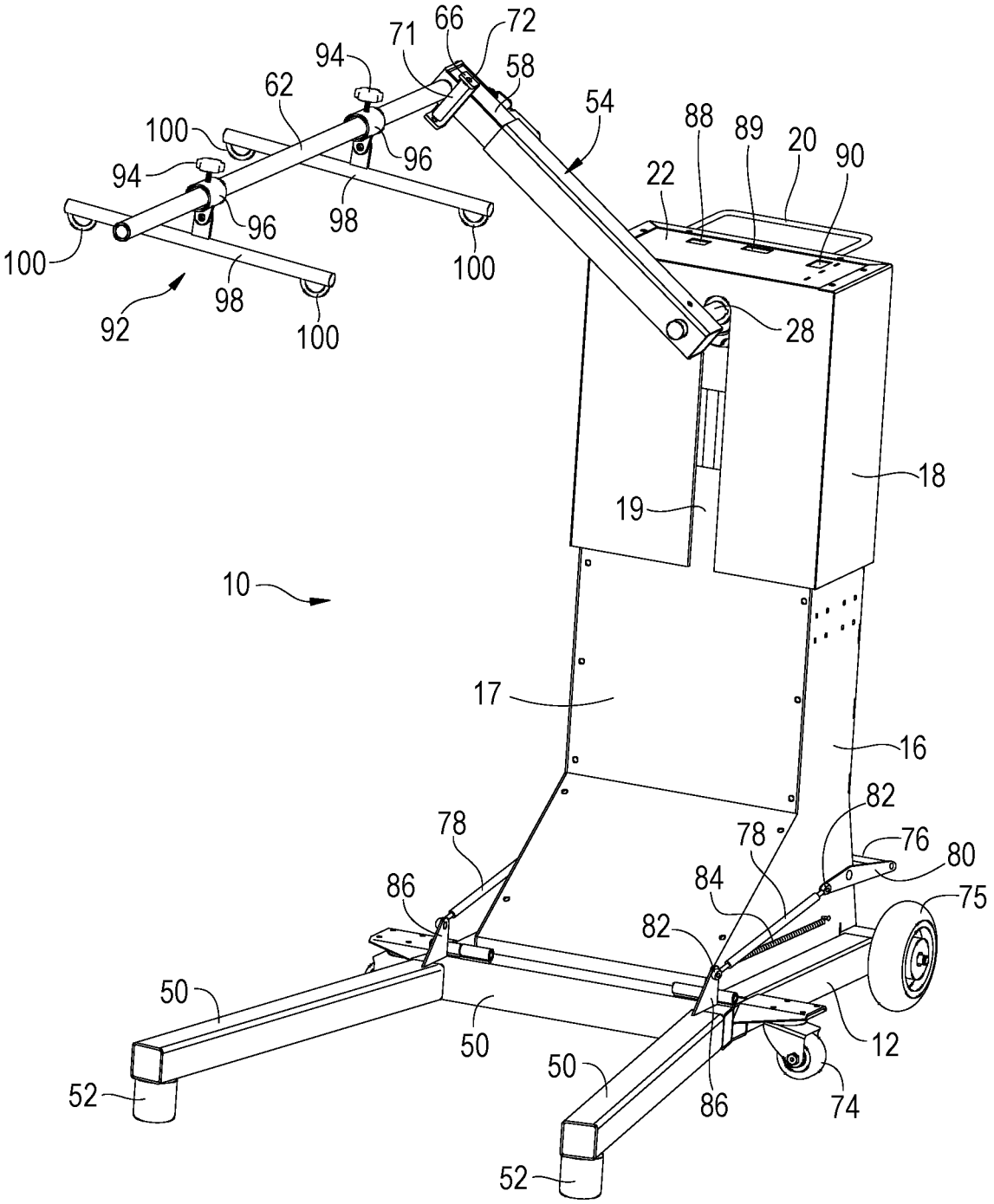
FIG. 1 is a front perspective view of the rotational leg lift machine.
Figure 2:
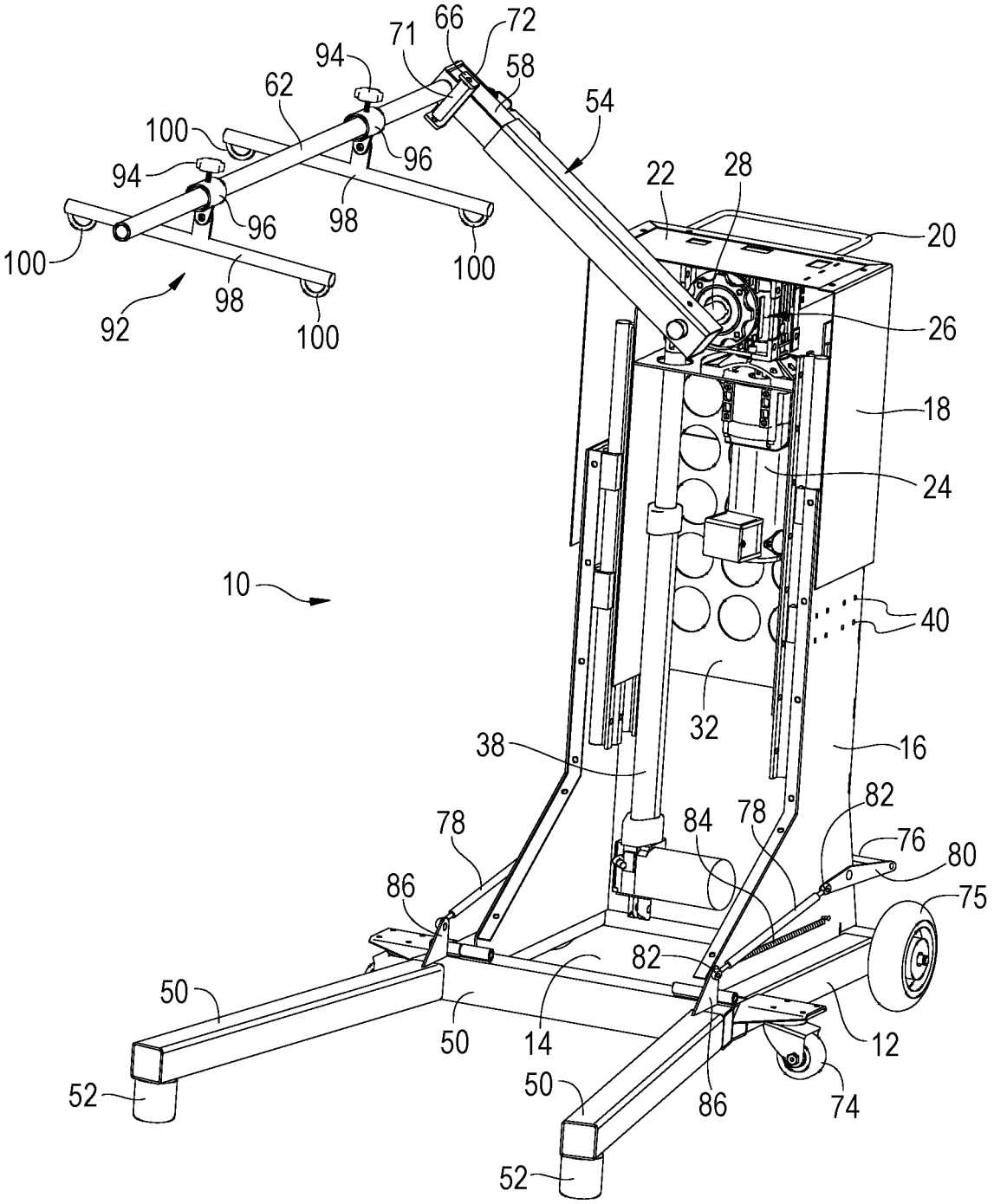
FIG. 2 is a front perspective view of the rotational leg lift machine with the front cover removed to show the internal components of the machine.
Figure 4:
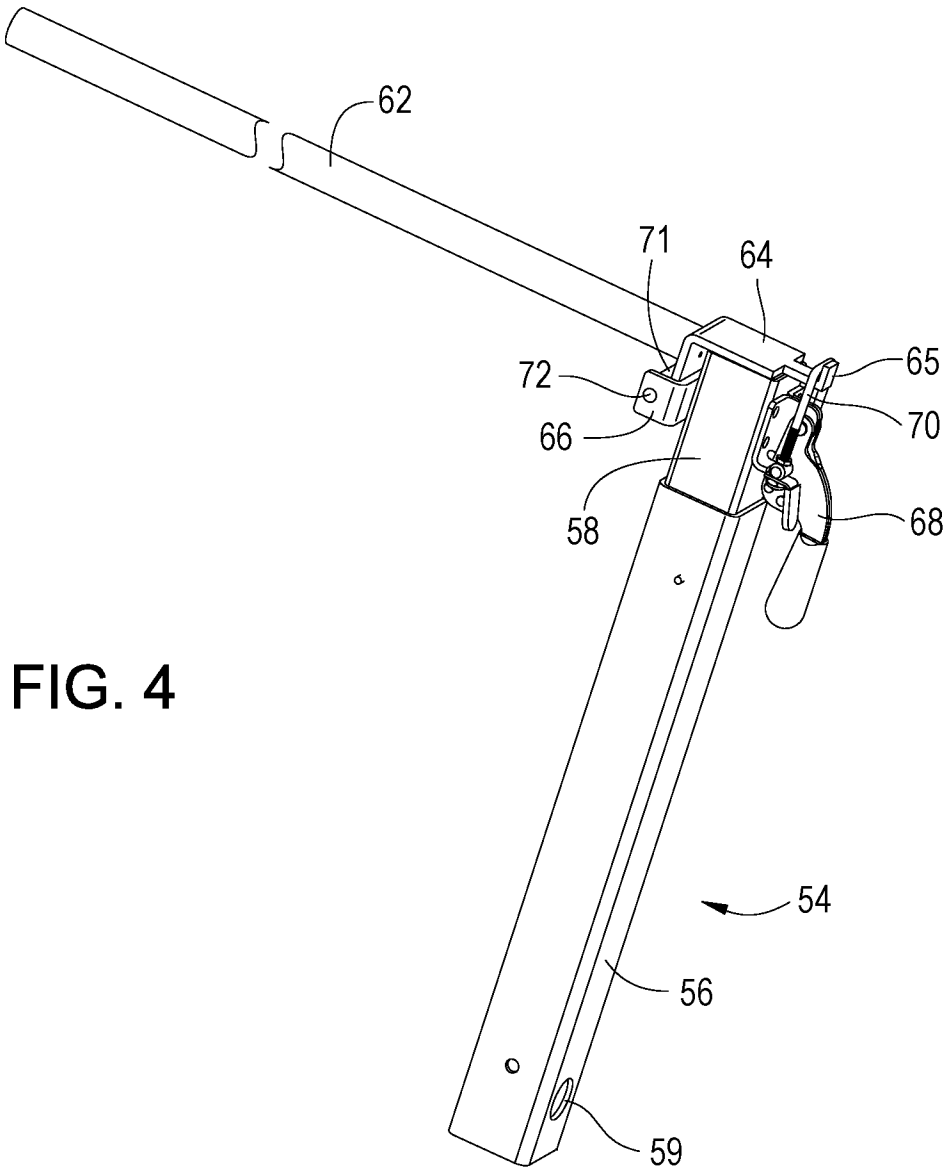
FIG. 4 is a perspective view of the rotating arm and leg support bar junction of the rotational leg lift machine.
Figure 5:
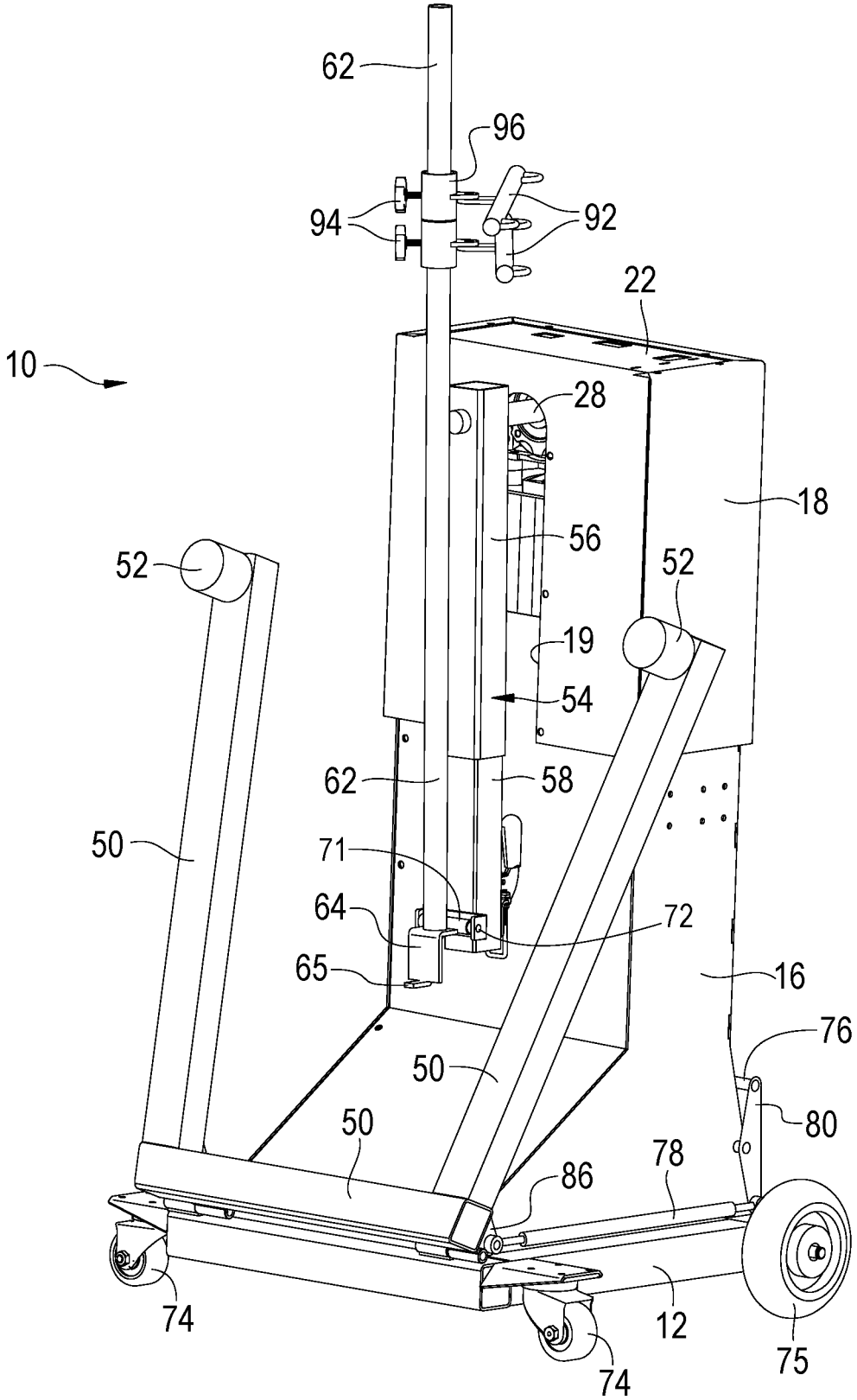
FIG. 5 is a front perspective view of the rotational leg lift machine showing the stabilizing leg frame and leg support bar in a retracted and storable position.

Referring now to FIG. 1 there is shown the leg lift machine 10 having a base assembly 12 that is rectangular in shape and comprised of metal tubing. Attached to said base assembly 12 is a lower housing 16 that has a front cover 17. Located above the lower housing 16 is an upper housing 18. The upper housing 18 has a slot 19 on its front face. The slot 19 allows for a gear shaft 28 to protrude from out of the slot 19. The shaft 28 emanates from a gearbox as shown in FIG. 2 that is connected to a motor. The shaft 28 is connected to a rotating arm 54. The rotating arm 54 travels in a vertical arc, or alternatively, rotates in a plane that is perpendicular to the ground. Attached to the rotating arm 54 at its terminal end is a leg support bar 62. As shown in FIG. 4, the leg support bar 62 has a locking bracket 64 that on one end has a locking tab 65 (as shown in FIG. 4) and on the other end a pivot tube 71. There is a hinge bracket 66 mounted on one side of the rotating arm 54 and a locking handle 68 and a latch 70 attached to said locking handle 68 on a rear side of the rotating arm 54. A hinge pin 72 is installed into hinge bracket 64 apertures and the pivot tube 71 when the leg support bar 62 is deployed for use. The latch 70 and locking handle 68 are deployed such that when the leg support bar 62 is perpendicular to the rotating arm 54, latch 70 is installed around a locking tab 65 located at the end of locking bracket 64 and the locking handle 68 is closed. For storage of the lift machine 10, the locking handle 68 is opened and the leg support bar 62 can be pivoted to a resting parallel position with the rotating arm 54 when the rotating 54 arm is in a vertical downward position as shown in FIG. 5. There is shown a handle 20 for use by a caregiver to move and wheel the lift machine 10 to a desired location.

Figure 3:
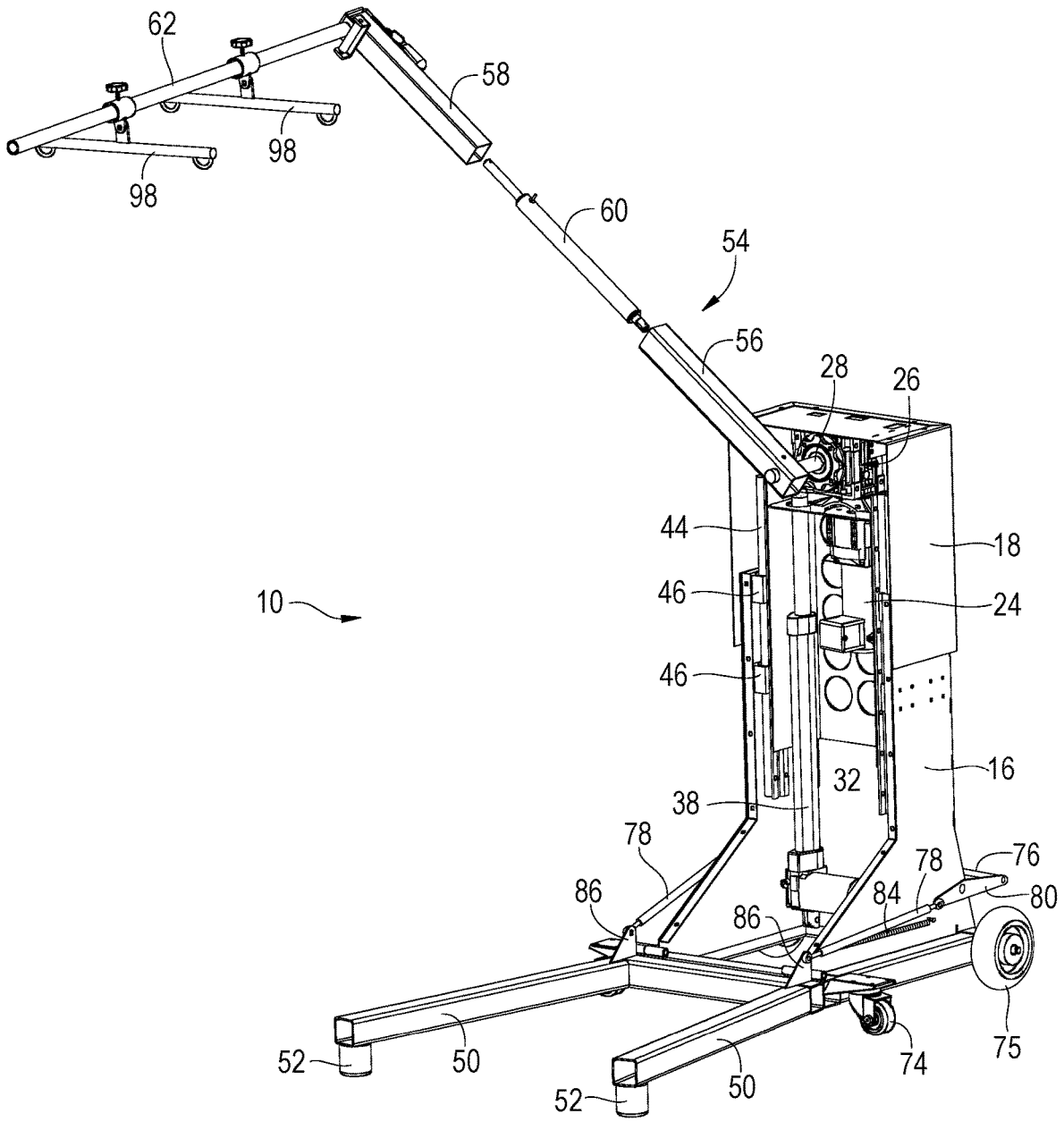
FIG. 3 is a front perspective of the rotational leg lift machine with the front cover removed to show the internal components of the machine and partially exploded rotating arm.

Referring now to FIG. 3, there is shown an exploded view of the rotating arm 54 where the rotating arm 54 is further comprised of an outer sleeve 56, an inner sleeve 58 and an extension linear actuator 60 that connects the outer sleeve 56 to the inner sleeve 58 and allows a caregiver to extend or retract the rotating arm to an appropriate length that a particular patient's physical size and height might require. The extension linear actuator 60 is electrically connected to a power source and control system such that a caregiver can easily adjust the length of the rotating arm 54 as required.

Figure 8:
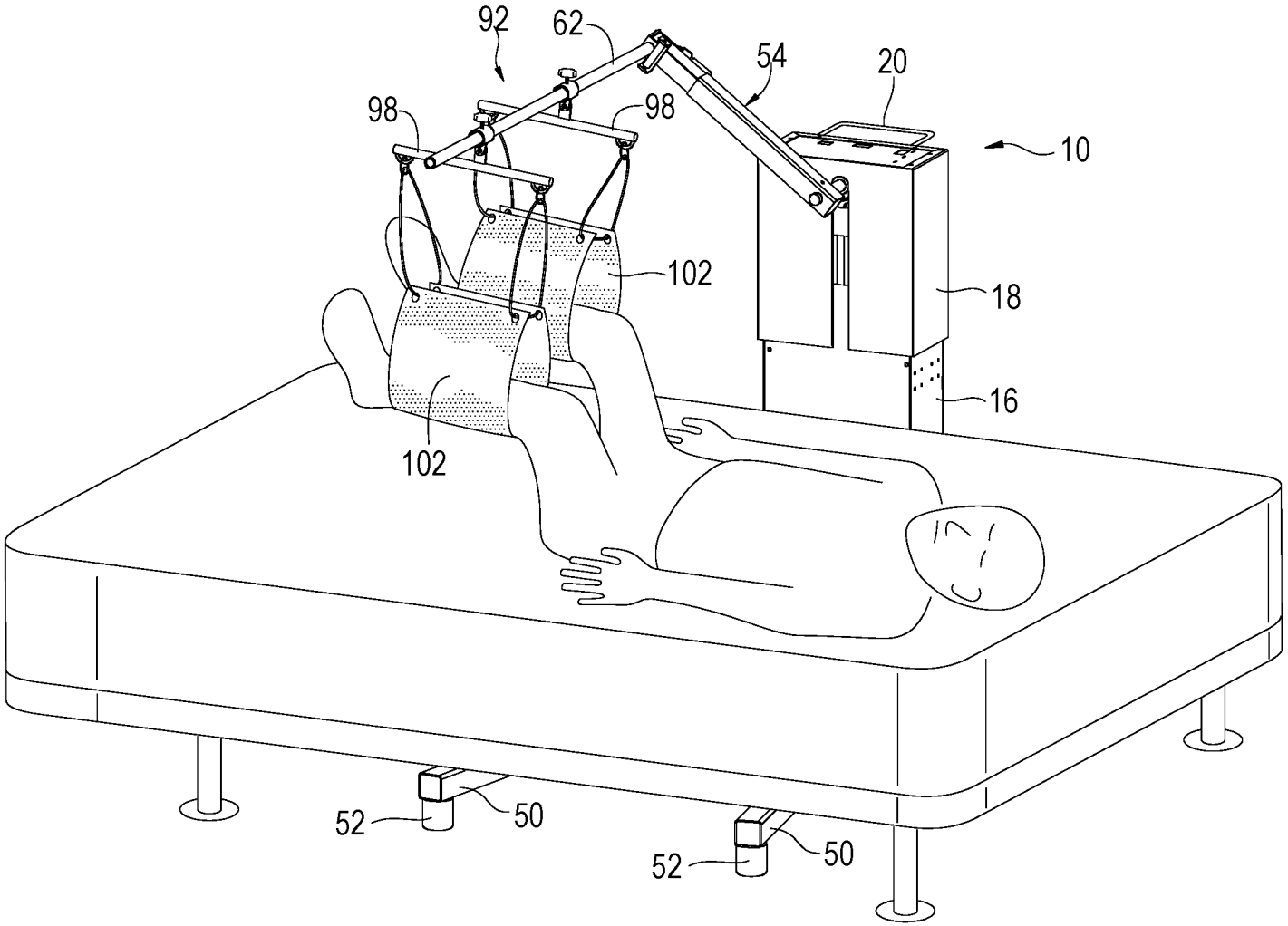
FIG. 8 is perspective view of the rotational leg lift machine being used on a patient.

Also shown in FIG. 1 is the leg support bar 62 with two sling assemblies 92 shown installed on the leg support bar. Each sling assembly has a sling support sleeve 96 that fits on the leg support bar 62 and is slidable along the length of the leg support bar 62. The sling support sleeve is pivotally connected to a sling support bar 98 that has loops 100 on either terminal end of said sling support bar 98. The sling support sleeves 96 each have a threaded aperture on their top side that allows locking handles 94 to be loosened when the sling support sleeve 96 needs to be moved to a different position to accommodate a particular patient's needs. The locking handles 94 can then be tightened to prevent any inadvertent dislodgement of the sling assemblies 92 on the leg support bar 62. The loops 100 are attachment for leg slings 102 and their associated straps as shown in FIG. 8.

Connected hingeably to the base assembly 12 is a stabilizing leg frame 50. There are connection plates 86 located on either side of the stabilizing leg frame 50 such that a deployment and retracting mechanism can be attached to said connection plates 86. Specifically, there is a deployment foot lever 76 that is attachable to a left and right lever plate 80. The lever plates 80 are attached to the bottom left and right side of the lower housing 16 at a central point in the lever plates 80. Attached to the opposite sides of the lever plates 80 are tie rods 78 that have ball joints 82. The opposite ends of the tie rods 78 are attached to said connection plates 86 located on the top surface of the stabilizing leg frame 50. A caregiver can deploy the stabilizing leg frame 50 by pushing their foot down on the deployment foot lever 76. The stabilizing leg frame 50 also has a plurality of rubber feet 52 such that once the rubber feet 52 come into contact with a floor surface they frictionally prevent the leg lift machine 10 from moving. Also shown are springs 84 that are connected to the end of the tie rods 78 closest to the stabilizing leg frame 50 on one of the spring 84 ends and the other spring 84 is connected rearward onto the lower housing 16. The springs 84 aid in retracting of the stabilizing leg frame 50 due to tension created in the springs 84 when the foot lever 76 is deployed. When a caregiver has used the leg lift machine 10 and has completed cleaning and dressing of a patient, the caregiver will use their foot to pull up on the deployment lever 76 and the springs 84 aid the caregiver in raising up and retracting the stabilizing leg frame 50. Also shown on the base assembly are caster wheels 74 located at the front of the base assembly 12 and wheels 75 located at the rear of the base assembly 12.

Figure 6:
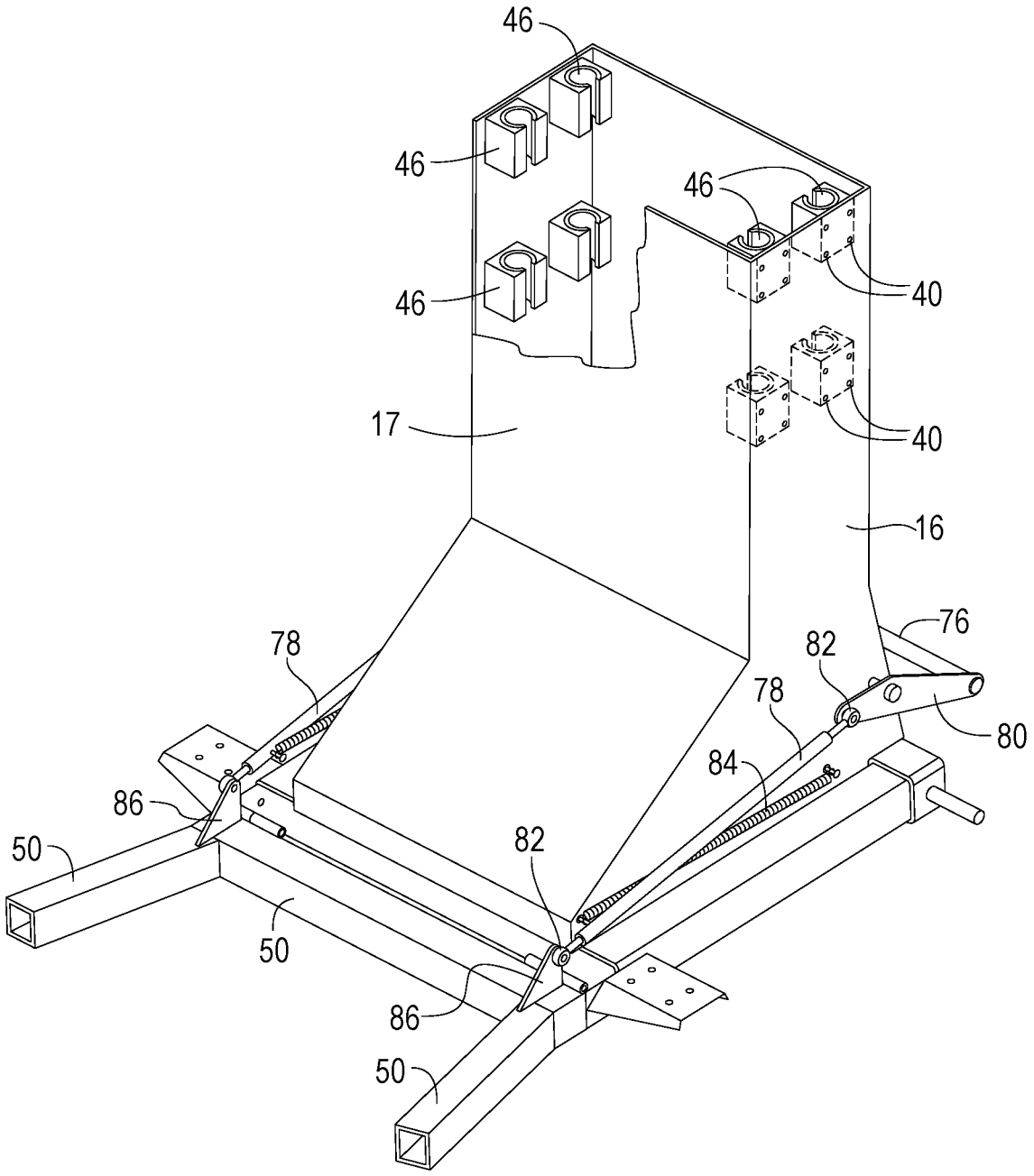
FIG. 6 is top perspective view and partial cutaway view of the lower housing of the rotational leg lift machine.
Figure 7:
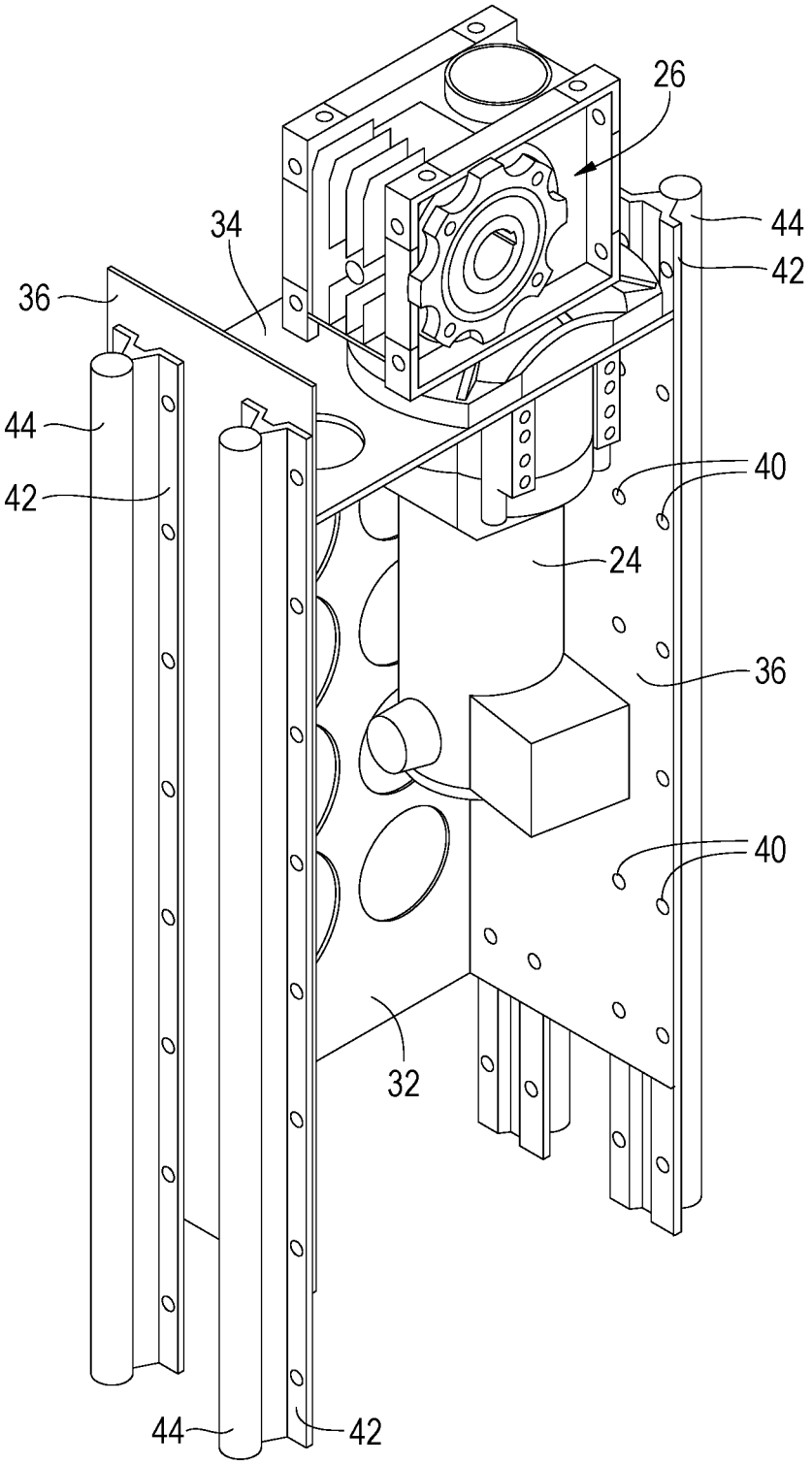
FIG. 7 is a top perspective view of the motor gearbox housing and internal components.

Turning to FIGS. 2, 6, and 7 there is shown a motor gearbox housing 32 have a top plate 34 and left and right side plates 36. The motor gear box side plates 36 have a plurality of apertures 40 located therein for the purpose of attaching two rails 44, parallel to each other, on the outer surface of the left and right side plates 36. A rail 44 would then be installed into the rail base 42 which creates a parallel set of rails 44 on each side of the motor gearbox housing side plates. The rails 44 are purposed for being inserted to corresponding linear bearings 46 located on the interior sidewalls of the lower housing 16 as shown in FIG. 6. This allows the motor gearbox housing 32 and components to travel up and down v3 said rails 44 and linear bearings 46 for smooth and uniform upward and downward movement. The upward and downward movement of the motor gearbox housing 32 and components can be achieved through a number of different means of providing upward and downward movement and travel of the motor gearbox housing 32 via rails 44 and corresponding linear bearings 46. These various means could include an electrically activated and operated linear actuator, a hydraulic cylinder using a hydraulic system, a foot operated pneumatic cylinder, or a chain and gear driven system operating with a motor off of electrical power. The motor gearbox housing 32 is one embodiment of a rigid framework and various other rigid frameworks could be constructed to mount the motor 24 and gearbox 26 as well as the lift linear actuator 38.

Mounted to the top plate 34 of the motor gearbox housing is a motor 24 mounted to a gearbox 26 drive that has a shaft 28 protruding horizontally outward. Further shown in FIGS. 2 and 3 is a lift linear actuator 38 that is attached to the base assembly at its bottom end and said lift linear actuator 38 is mounted to the top plate 34 of the motor gearbox housing 32. The lift linear actuator 38 as well as the motor 24 is electrically connected to a power system as well as a control system. Mounted to the top of the motor gearbox housing 32 is the top cover 22 and mounted to the top cover 22 is the upper housing 18 which protects and keeps from view the motor 24 and gear box 26 and any associated electrical wiring and connections. Located on the top cover 22 is a lift electronic control 88, a motor gearbox shaft electrical control 89, and an extension electronic control 90. Actuating the lift electronic control 88 either raises or lowers the lift linear actuator 38. Actuating the motor gearbox electronic control 89 rotates the shaft 28 and rotating arm 54 either clockwise or counter-clockwise. Actuating the rotating arm electric control 90 causes the rotating arm 54 to either extend or retract in length.

Referring now to FIG. 8 illustrates the rotational leg lift machine 10 in use. In use, a caregiver would use the handle 20 to roll the rotational leg lift machine 10 via wheels 75 and caster wheels 74 next to the side of a patient's bed. The caregiver would then deploy the stabilizing leg frame 50 and advance the machine 10 closer to the patient's bed such that the stabilizing leg frame 50 is ultimately underneath the patient's bed. The rotational leg lift machine 10 can be used on both sides of a patient's bed due to the three hundred and sixty degree rotation capability of the rotation arm 54. The caregiver would then position the rotational leg lift machine 10 next to a patient's bed and locate the shaft attached to the rotating arm directly at the hip region of a patient and lifting the shaft 28 to a position where it is level with the patient hip region. The caregiver would then rotate the rotating arm 54 via the gearbox shaft electrical control 89 to where said rotating arm 54 is parallel to the patient's body and slightly above the patient's body. The next step would be for a caregiver to extend the rotating arm 54 via the extension linear actuator 60 via the extension electronic control 90 such that the leg support bar 62 is directly above the knee region of a patient. A caregiver would then insert a sling 102 under each leg of a patient directly under the knee in the calf region of a patient attaching each said sling 102 to a sling assembly 92 located on the leg support bar 62. A caregiver would then rotate the rotating arm 54 up and rearwards via an electronic control such that a patient's legs are lifted up and rearward in arc to allow a caregiver to have easy and safe access to a patient's private areas and allowing the caregiver to easily and safely sanitize the patient's private areas and changing of undergarments.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

ELEMENTS

10 Leg lift machine
12 Base assembly
14 Base floor
16 Lower housing
17 lower housing front cover
18 Upper housing
19 Slot
20 Handle
22 Top cover
24 Gear motor
26 Gear box
28 Motor shaft
32 Motor gear box housing
34 Motor gear box housing top plate
36 Motor gear box side plate(s)
38 Lift linear actuator
40 Apertures
42 Rail base
44 Rail
46 Linear bearing
50 Stabilizing leg frame
52 Rubber foot
54 Rotating arm
56 Outer sleeve
58 Inner sleeve
59 Shaft aperture
60 Extension linear actuator
62 Leg support bar
65 Locking tab
64 Locking bracket
66 Hinge bracket
68 Locking handle
70 Latch
71 Pivot tube
72 Hinge pin
74 Caster wheels
75 Wheel
76 Deployment foot lever
78 Tie rods
80 Lever plate
82 Ball joints
84 Spring
86 Connection plates on stabilizing leg frame
88 Lift electric control
89 Gearbox shaft electric control
90 Rotational arm electric control
92 Sling assembly
94 Locking handle
96 Sling support sleeve
98 Sling support bar
100 Loops
102 Sling

What I claim is:

1. A rotational leg lift machine for sanitizing a patient, comprising:

a base assembly;

a rigid framework installed onto the top surface of said base assembly whereby said rigid framework houses a motor gear driven rotatable shaft and whereby there is located within said framework means for lifting the motor gear drive rotatable shaft up and down;

a rotating arm attached to said motor gear driven rotatable shaft such the rotating arm rotates in a three hundred and sixty degree vertical arc via connection to a power source; and a leg support bar located on a terminal end of the rotating arm and positioned perpendicular to said rotating arm and purposed for attaching slings to said leg support bar that are configured to be placed under the patient's lower legs and actuating said motor gear driven rotatable shaft via a power source such that the rotating arm and leg support bar are configured to rotate the patient's legs upward and rearward to the patient's torso so as to give a caregiver easy access to sanitize and change the undergarments of the patient.

2. The rotational leg lift machine for sanitizing a patient of claim 1 wherein the rotating arm is further comprised of an outer sleeve and an inner sleeve and an extension linear actuator is located within the outer sleeve and the inner sleeve and connects the inner sleeve to the outer sleeve and a power source connected to the linear actuator whereby said rotating arm can be extended or retracted depending upon the patient's height.

3. The rotational leg lift machine for sanitizing a patient of claim 1 further comprising a stabilizing leg frame hingeably connected to the base assembly and said stabilizing leg frame can be deployed outward in front of the rotational leg lift machine and locked into place and retracted upwards for storage when the leg lift machine is not in use.

4. The rotational leg lift machine for sanitizing a patient of claim 3 wherein there is a foot actuated locking lever that is configured to be deployed by a caregiver and locks the stabilizing leg frame onto the ground and provides aid in retracting the stabilizing leg frame via use a plurality of springs.

5. The rotational leg lift machine for sanitizing a patient of claim 4 wherein a plurality of rubber feet are located on the bottom surface of the stabilizing leg frame purposed for providing a frictional connect of the machine with the ground.

6. The rotational leg lift machine for sanitizing a patient of claim 1 further comprising wheels located on the base assembly to allow the machine to be mobile.

7. The rotational leg lift machine for sanitizing a patient of claim 1 further comprising two sling assemblies that mount on to the leg support bar and slide along the length of the leg support bar and lock onto the leg support bar at a caregiver chosen location to properly position the legs of the patient.

8. The rotational leg lift machine for sanitizing a patient of claim 1 wherein the leg support bar is hingeably connected to the rotating arm whereby the leg support bar can be deployed to an operational position of being parallel to the ground or can be undeployed into a vertical folded position against the rotating arm via a latching device for storage of the machine.

9. A rotational leg lift machine for sanitizing a patient, comprising:

a base assembly attached to a lower housing whereby said lower housing further comprises a plurality of linear bearings attached to interior sidewalls of said lower housing such that the linear bearings are vertically oriented;

a motor gearbox housing having a left side plate, a right side plate and a top plate whereby there are two parallel rails attached to rail bases whereby said rail bases are attached to the outer surface of the left side plate of the motor gearbox housing and two parallel rails are attached to rail bases that are attached to outer surface of the right side plate;

a motor and a gearbox mounted to said top plate of said motor gearbox housing whereby the gearbox has a rotatable shaft and said motor gearbox housing is inserted into the lower housing such that the rails engage and are inserted into the linear bearings located in the lower housing;

a lift linear actuator having its bottom portion mounted onto the base assembly and said lift linear actuator having its top portion mounted to the top plate of the motor gearbox housing;

a top cover mounted to the top plate of the motor gearbox housing and an upper housing mounted onto the top cover and said upper housing has a slot that allows the shaft to travel in the slot as the lift machine is actuated up and down;

a rotating arm attached to said rotatable shaft such the rotating arm rotates in a three hundred and sixty degree vertical arc via connection of the motor and the gearbox to a power source;

a leg support bar located on a terminal end of the rotating arm and positioned perpendicular to said rotating arm and purposed for attaching slings to said leg support bar that are configured to be placed under the patient's lower legs and actuating said motor gear driven rotatable shaft via a power source such that the rotating arm and leg support bar are configured to rotate the patient's legs upward and rearward to the patient's torso so as to give a caregiver easy access to sanitize and change the undergarments of the patient; and a power source and control system for operation of the rotatable leg lift machine.

10. The rotational leg lift machine for sanitizing a patient of claim 9 wherein the rotating arm is further comprised of an outer sleeve, an inner sleeve and an extension linear actuator whereby said extension linear actuator is located within the outer sleeve and the inner sleeve and connects the inner sleeve to the outer sleeve and a power source connected to the linear actuator whereby said rotating arm can be extended or retracted depending upon the patient's height.

11. The rotational leg lift machine for sanitizing a patient of claim 9 further comprising a stabilizing leg frame hingeably connected to the base assembly and said stabilizing leg frame can be deployed outward in front of the rotational leg lift machine and locked into place and retracted upwards for storage when the leg lift machine is not in use.

12. The rotational leg lift machine for sanitizing a patient of claim 11 wherein there is a foot actuated locking lever that is configured to be deployed by a caregiver and locks the stabilizing leg frame onto the ground and provides aid in retracting the stabilizing frame via use a plurality of springs.

13. The rotational leg lift machine for sanitizing a patient of claim 12 wherein a plurality of rubber feet are located on the bottom surface of the stabilizing leg frame purposed for providing a frictional connect of the machine with the ground.

14. The rotational leg lift machine for sanitizing a patient of claim 9 further comprising wheels located on the base assembly to allow the machine to be mobile.

15. The rotational leg lift machine for sanitizing a patient of claim 9 further comprising two sling assemblies that mount on to the leg support bar and slide along the length of the leg support bar and lock onto the leg support bar at a caregiver chosen location to properly position the legs of the patient.

16. The rotational leg lift machine for sanitizing a patient of claim 9 wherein the leg support bar is hingeably connected to the rotating arm whereby the leg support bar can be deployed to an operational position of being parallel with the ground or can be retracted into a vertical folded position against the rotating arm via a latching device for storage of the machine.

17. A method for sanitizing a bedridden patient and changing their undergarments, comprising the steps of:

providing a rotational leg lift machine comprising a base assembly, a rigid framework installed onto the top surface of said base assembly whereby said rigid framework houses a motor gear driven rotatable shaft and whereby there is located within said framework means for lifting the motor gear drive rotatable shaft up and down, a rotating arm attached to said motor gear driven rotatable shaft such the rotating arm rotates in a three hundred and sixty degree vertical arc via connection to a power source and whereby the rotating arm is comprised of an outer sleeve, an inner sleeve and an extension linear actuator that is located inside the inner sleeve and outer sleeve and said extension linear actuator connects the outer sleeve to the inner sleeve of the rotating arm, a stabilizing leg frame hingeably connected to the base assembly such that the stabilizing leg frame can be deployed in front of the machine and locked, a leg support bar located on a terminal end of the rotating arm and positioned perpendicular to said rotating arm and purposed for attaching slings to said leg support bar that have been placed under the patient's lower legs and actuating said motor gear driven rotatable shaft via a power source such that the rotating arm and leg support bar rotate the patient's legs upward and rearward to the patient's torso so as to give a caregiver easy access to sanitize and change the undergarments of the patient;

rolling the machine next to the side of a patient's bed;

deploying the stabilizing leg frame and advancing the machine closer to the patient's bed such that the stabilizing leg frame is ultimately underneath the patient's bed;

positioning the rotational leg lift machine next to the patient's bed and locating the shaft attached to the rotating arm directly at a hip region of the patient and lifting the shaft to a position where it is level with the patient hip region;

rotating the rotating arm via an electrical control to where said rotating arm is parallel to the patient's body and slightly above the patient's body;

extending the rotating arm via the extension linear actuator via an electronic control such that the leg support bar is directly above the knee region of the patient;

inserting a sling under each leg of the patient directly under the knee in the calf region of the patient;

attaching each said sling to a sling assembly located on the leg support bar;

rotating the rotating arm up and rearwards via an electronic control such that the patient's legs are lifted up and rearward in an arc to allow a caregiver to have easy and safe access to the patient's private areas; and sanitizing by a caregiver of the patient's private areas and changing of undergarments.

18. The method of claim 17 further comprising the steps of retracting the stabilizing leg frame via a lever, rotating the rotating arm such that it is in a position point directly downward, unlatching a lever that is located at the junction of the leg support bar and rotating arm, and folding the leg support bar upwards and inwards to come to rest at position parallel to the rotating arm such that the machine can be easily stored in a location that is unobtrusive to the patient's medical room.

* * * * *